US007070504B2

(12) United States Patent
Iwamoto

(10) Patent No.: US 7,070,504 B2
(45) Date of Patent: Jul. 4, 2006

(54) GAMING APPARATUS WITH DISPLAYING SYMBOLS ON DISPLAY REGIONS WHERE A PLURALITY OF TYPES OF SYMBOLS ARE VARIABLY DISPLAYED

(75) Inventor: Hideaki Iwamoto, Tokyo (JP)

(73) Assignee: ARUZE Co., Ltd., Tokyo (JP)

( * ) Notice: Subject to any disclaimer, the term of this patent is extended or adjusted under 35 U.S.C. 154(b) by 192 days.

(21) Appl. No.: 10/400,135

(22) Filed: Mar. 25, 2003

(65) Prior Publication Data

US 2004/0014518 A1 Jan. 22, 2004

(30) Foreign Application Priority Data

Jul. 17, 2002 (JP) ..... 2002-208805

(51) Int. Cl.
*A63F 9/24* (2006.01)

(52) U.S. Cl. ..... 463/20; 463/16

(58) Field of Classification Search ..... 463/16, 463/20; 273/143 R

See application file for complete search history.

(56) References Cited

U.S. PATENT DOCUMENTS

| | | | | |
|---|---|---|---|---|
| 5,934,672 | A * | 8/1999 | Sines et al. | 273/143 R |
| 6,227,971 | B1 | 5/2001 | Weiss | |
| 6,234,897 | B1 | 5/2001 | Frohm et al. | |
| 6,517,432 | B1 * | 2/2003 | Jaffe | 463/16 |
| 6,551,187 | B1 * | 4/2003 | Jaffe | 463/20 |
| 2002/0039918 | A1 * | 4/2002 | Anderson et al. | 463/16 |

FOREIGN PATENT DOCUMENTS

| | | | |
|---|---|---|---|
| EP | 0 874 337 | A1 | 10/1998 |
| EP | 1 067 491 | A2 | 1/2001 |
| EP | 1 083 531 | A1 | 3/2001 |
| JP | H10-216299 | | 8/1998 |
| JP | H11-169505 | | 6/1999 |
| JP | H11-244453 | | 9/1999 |
| JP | H11-253610 | | 9/1999 |
| JP | H11-276663 | | 10/1999 |
| JP | H11-290505 | | 10/1999 |
| JP | P2001-62027 | A | 3/2001 |
| JP | P2001-79139 | A | 3/2001 |
| JP | P2001-178868 | A | 7/2001 |
| JP | P2001-246044 | A | 9/2001 |
| JP | P2002-320713 | A | 11/2002 |
| JP | P2003-19242 | A | 1/2003 |
| JP | P2003-24510 | A | 1/2003 |
| JP | P2003-62171 | A | 3/2003 |
| JP | P2003-62176 | A | 3/2003 |
| JP | P2003-62177 | A | 3/2003 |
| JP | P2003-62178 | A | 3/2003 |
| JP | P2003-79931 | A | 3/2003 |
| JP | P2003-93586 | A | 4/2003 |
| JP | P2003-93587 | A | 4/2003 |
| WO | WO 00/12186 | A1 | 3/2000 |

* cited by examiner

*Primary Examiner*—Julie Brocketti

(57) ABSTRACT

When a doghouse symbol (T5) is displayed in the display region (E2) where the varying display is stopped at last, a Toby image (42) running from the doghouse symbol (T5) toward a display region (A2) is displayed. The display that the Toby image (42) jumps into the display region (A2) is made, and a regular symbol displayed in the display region (A2) changes into a Toby symbol (T2). The chance games are executed for three times at maximum. Therefore, it is possible to provide a gaming apparatus whose attractiveness is enhanced by making a variety of display for announcing a game's state.

14 Claims, 18 Drawing Sheets

GAMING APPARATUS WITH DISPLAYING SYMBOLS ON DISPLAY REGIONS WHERE A PLURALITY OF TYPES OF SYMBOLS ARE VARIABLY DISPLAYED

FIELD OF THE INVENTION

The present invention relates to a gaming apparatus which notifies a player of a game state by displaying a symbol on a plurality of display regions, a control method of a gaming apparatus, a program and a recording medium readable by a computer.

RELATED ART

A slot machine is cited as a representative gaming apparatus in which it is judged whether a winning prize condition is satisfied or not, and a symbol is shown in each of a plurality of display regions, and it is announced to a player whether a winning prize condition is satisfied or not. For such a slot machine, as a policy to attract the interest of a player, the gaming machine in which a higher payment rate of coins and the like can be achieved with a bonus game in addition to a so-called basic game is more popular than a gaming machine performing merely the basic game. Since a rate of the paid prize money and medals can be made high or low by providing such a bonus game in addition to the basic game, the attractiveness is surely increased compared to the gaming apparatus which performs merely the basic game. For example, in a conventional slot machine, whether the bonus game will be performed or not is announced to a player by a predetermined symbol being displayed in a plurality of display regions.

Usually the player is playing in the hope of the bonus game being performed, and the judgment for shifting from the basic game to the bonus game is the greatest concern for the player. If the player is notified whether the basic game is shifted to the bonus game or not by displaying on a display a mere announcement that a bonus game will be performed, it may decrease the interest of the player demanding stimulation. Such a player demands the appearance of the gaming apparatus which increases a feeling of expectation of shifting to a bonus game.

Thus, it is an object of the present invention to provide a gaming apparatus whose attractiveness is enhanced by making a display announcing a game state diversified, a control method of the gaming apparatus, a program and a recording medium thereof readable by a computer.

SUMMARY OF THE INVENTION

A gaming apparatus according to the present invention that solves the problem mentioned above comprises: a display having a plurality of display regions where a plurality of types of symbols are varyingly displayed; and a controller which executes a specified program and controls the display contents, and the controller determines a symbol from a plurality of types of symbols which should be displayed on each display region according to the program, stops and displays each symbol in turn in multiple display regions where symbols are displayed varyingly, executes the basic game for the winning prize judgment based on a combination of symbols displayed on the display regions, and, when a predetermined specific condition is satisfied, stops and displays a predetermined symbol in a display region where symbols are varyingly displayed last among the display regions so as to perform a game different from the basic game.

In a gaming apparatus according to the present invention, the basic game and the game different from the basic game are executed. Since a different game, other than the monotonous basic game, is available, a player can expect a shift to the different game. When the basic game is determined to shift to the different game, a predetermined symbol is displayed on the display region where symbols are varyingly displayed last among the display regions. Therefore, the player can anticipate such a shift to the different game until the varyingly displayed symbols are stopped, thereby raising the attractiveness thereof as much. Herein, in a preferable embodiment, the predetermined symbol shall be displayed only in the display region where symbols are varyingly displayed last among the plurality of display regions.

In the present invention, a predetermined symbol to announce a shift to the different game is not provided in the display regions other than the display region where symbols are varyingly displayed last, and it is possible to display the predetermined symbol only in the display region where symbols are varyingly displayed last.

Therefore, it is possible to raise a feeling of satisfaction for a shift to the different game by letting the player see this predetermined symbol at last because the player does not see the predetermined symbol announcing a shift to the different game until symbols, which are stopped and appear, are displayed in all other display regions. Therefore, it is possible to raise an attractiveness of the game further more.

Moreover, in a preferable embodiment, it is desirable, after having displayed the predetermined symbol, to move a specified pattern from the predetermined symbol toward a display region other than the display region where the predetermined symbol are displayed last among the plurality of display regions.

It is possible for the player to feel aroused when the game is shifted to the different game as a specified pattern is motion-displayed from the predetermined symbol which is stopped last toward other display regions. As a result, it is possible to make a highly attractive game.

Moreover, according to the present invention, a control method is provided for a gaming apparatus comprising a display having a plurality of display regions where a plurality of types of symbols are displayed varyingly and a controller executing a predetermined program and controlling a display content on said display. The control method comprises the steps of: determining a symbol which should be displayed in each display region among the plurality of types of symbols, sequentially stopping a symbol in each display region where symbols are displayed varyingly, executing a basic game judging a prize based on an arrangement of symbols displayed in the display regions, displaying a predetermined symbol in the display region where symbols are varyingly displayed last among the plurality of display regions when a predetermined condition is fulfilled, and executing an attractive game different from said basic game.

In a control method of a gaming apparatus according to the present invention, a basic game and a game different from the basic game are performed, and, if the game other than the monotonous basic game is prepared, a player will expect a shift to the different game. And because a predetermined symbol is displayed in the display region where symbols are varyingly displayed last when the shift to the different game is made, the player can continue to expect a shift to the different game until the varyingly displayed symbols are stopped at last. Therefore, it is possible to maintain a feeling of expectation of the player for a long period of time.

Moreover, it is preferable that, after a predetermined symbol is stopped and appears, a specified pattern is motion-displayed from the predetermined symbol towards a display region other than the display region where the predetermined symbol has been displayed among the plurality of display regions. In this way, it is possible that the player may feel aroused when the game is shifted to the different game as a specified pattern is motion-displayed, from the display region where the predetermined symbol having been stopped at last, towards other display regions. As a result, it is possible to make a highly attractive game.

Furthermore, a program according to the present invention allows the computer to execute the steps of: displaying multiple display regions where multiple types of symbols are displayed on a display in motion, determining a symbol to be displayed in each display region from multiple types of symbols, stopping and showing in turn a symbol in each of multiple display regions where symbols are displayed varyingly, executing a basic game in which a winning prize is judged based on a combination of displayed symbols, displaying the predetermined symbol in the display region where symbols are varyingly displayed last among the multiple display regions when a predetermined specific condition is satisfied, and executing the game different from the basic one.

The recording medium readable by a computer of the present invention is a medium in which the above-described program is recorded.

It is possible to obtain the effect that is described in the explanation of the gaming apparatus and the control method thereof, by making the computer execute a program according to the present invention or a program recorded in the recording medium. Thus, it is possible to maintain a feeling of expectation for a long period of time when the game is shifted to the different one, thereby letting a player feel a sense of superiority and enhancing a feeling of satisfaction furthermore. Other features and advantages of the invention will be apparent from the following description with reference to the accompanying drawings.

PREFERRED EMBODIMENTS OF THE INVENTION

The preferable embodiment of the present invention is explained based on the attached drawings hereafter in detail.

Figure 1:
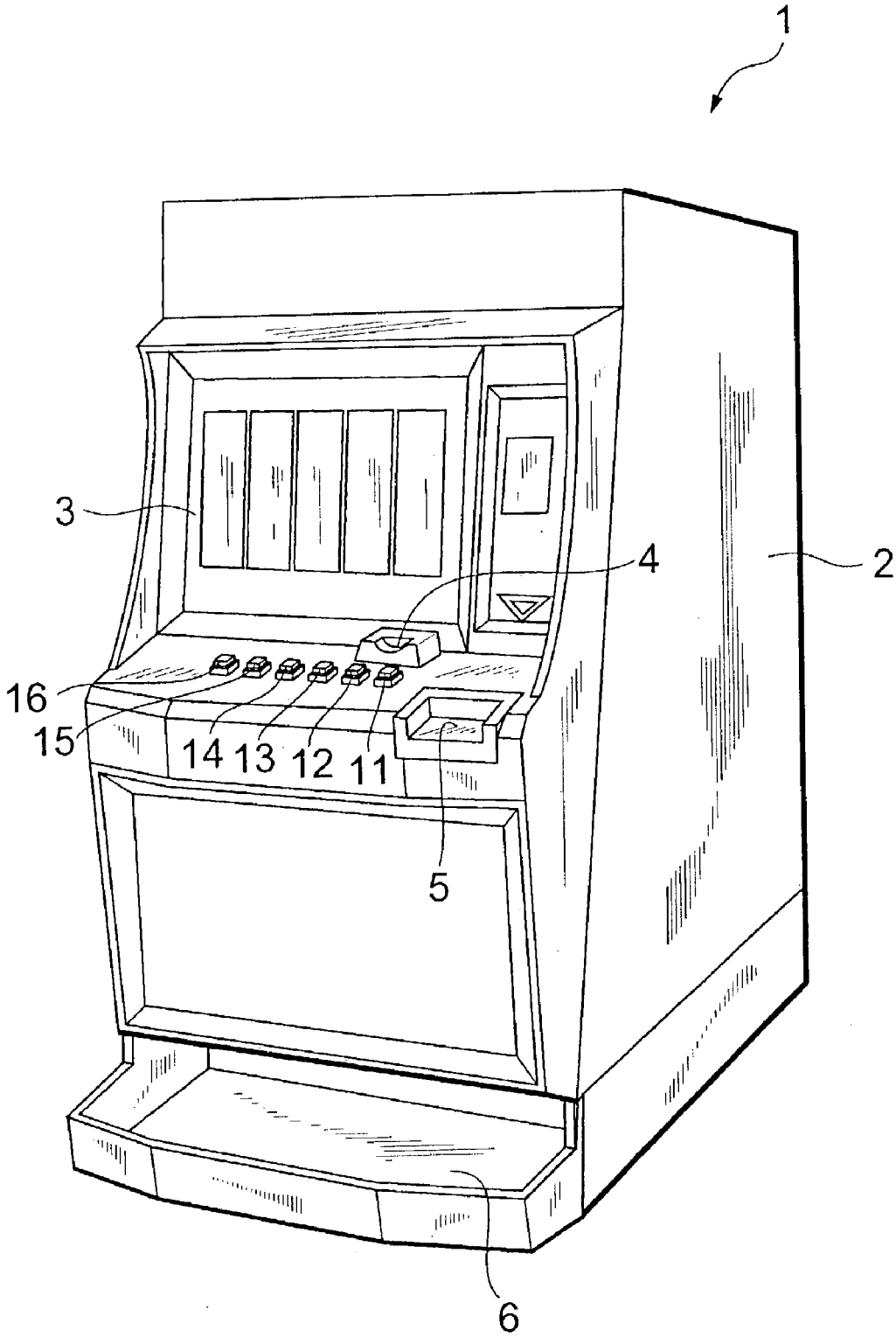
FIG. 1 is an outer perspective view of a gaming apparatus slot machine according to the embodiment of the present invention.

FIG. 1 is an entire perspective view showing a slot machine according to this embodiment. A slot machine 1, a gaming apparatus of the present invention, has a housing 2, which is provided with a display 3 comprising a liquid crystal display for digitally displaying a slot game. A coin slot 4 for dropping media such as medals and coins ("coin(s)" is a general term for these media hereafter) and a bill inserter 5 for inserting bills are provided in a front lower part of the display 3. A player can perform a slot game with either coin or bill. Of course, it is possible to allow a game to be performed only with coin or bill. Moreover, a coin receiving section 6 for a player to receive coins to be paid to him is provided in the lowest section of the housing 2.

Moreover, on the front side of the coin slot 4, six push buttons are arranged. These buttons are provided often on known slot game machines and are arranged from the right in the order of a start button 11 to instruct the symbols to start to rotate, a BET button 12 to instruct 1 BET, a MAXBET button 13 to bet from the remaining credit to the maximum number of bets (for example 20), a REPEATBET button 14 to BET by the same number of bets as being made in the previous game, a collect button 15 to settle the coins having been acquired by the game, and a payout button 16 to instruct to pay coins.

Figure 2:
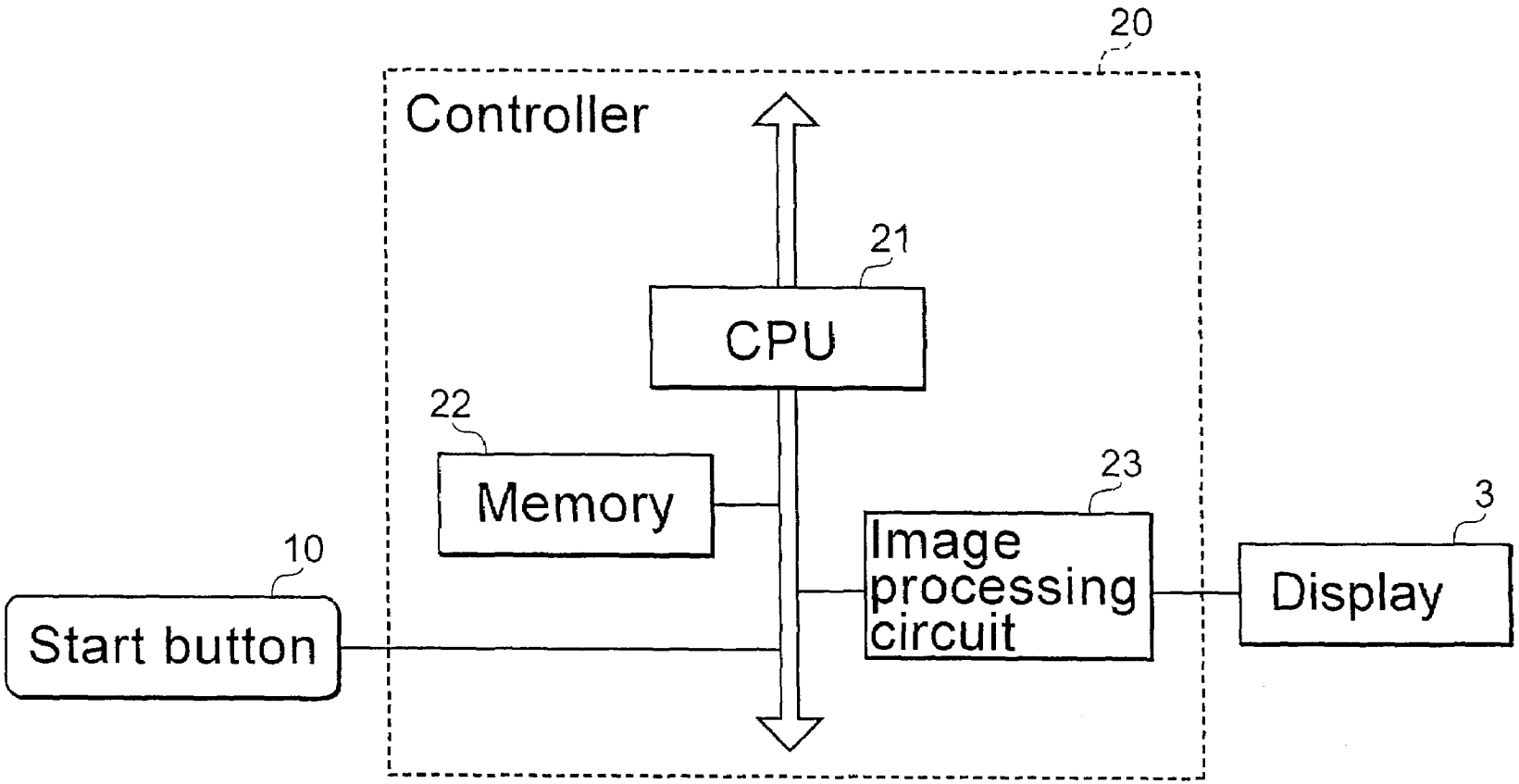
FIG. 2 is a block diagram showing a controller controlling a slot machine and various actuators electrically connected thereto.

FIG. 2 is block diagram showing the controller controlling the processing of the slot machine and various actuators electrically connected thereto.

The controller 20 comprises a CPU 21 supervising various controls of the slot machine, a memory 22 storing a program necessary for a slot game and data, a Video RAM, and an image processing circuit 23 controlling display contents of display 3. Moreover, I/O ports are arranged appropriately between the CPU 21 and each actuator.

Moreover, the memory 22 has ROM and RAM areas, and the ROM area includes, at least, a program having a module for executing a basic game and a bonus game, and data for a pay table displaying a payout according to the symbol array and the symbol image. On the other hand, in the RAM area of memory 22 are written variable data such as the number of bets, the number of credits, etc., of the player.

Furthermore, a coin sensor to detect that a coin has been dropped and the start button 11 are connected to the CPU 21 through a bus. Various buttons and bill sensors (not shown) are also connected to the controller 20.

Figure 3:
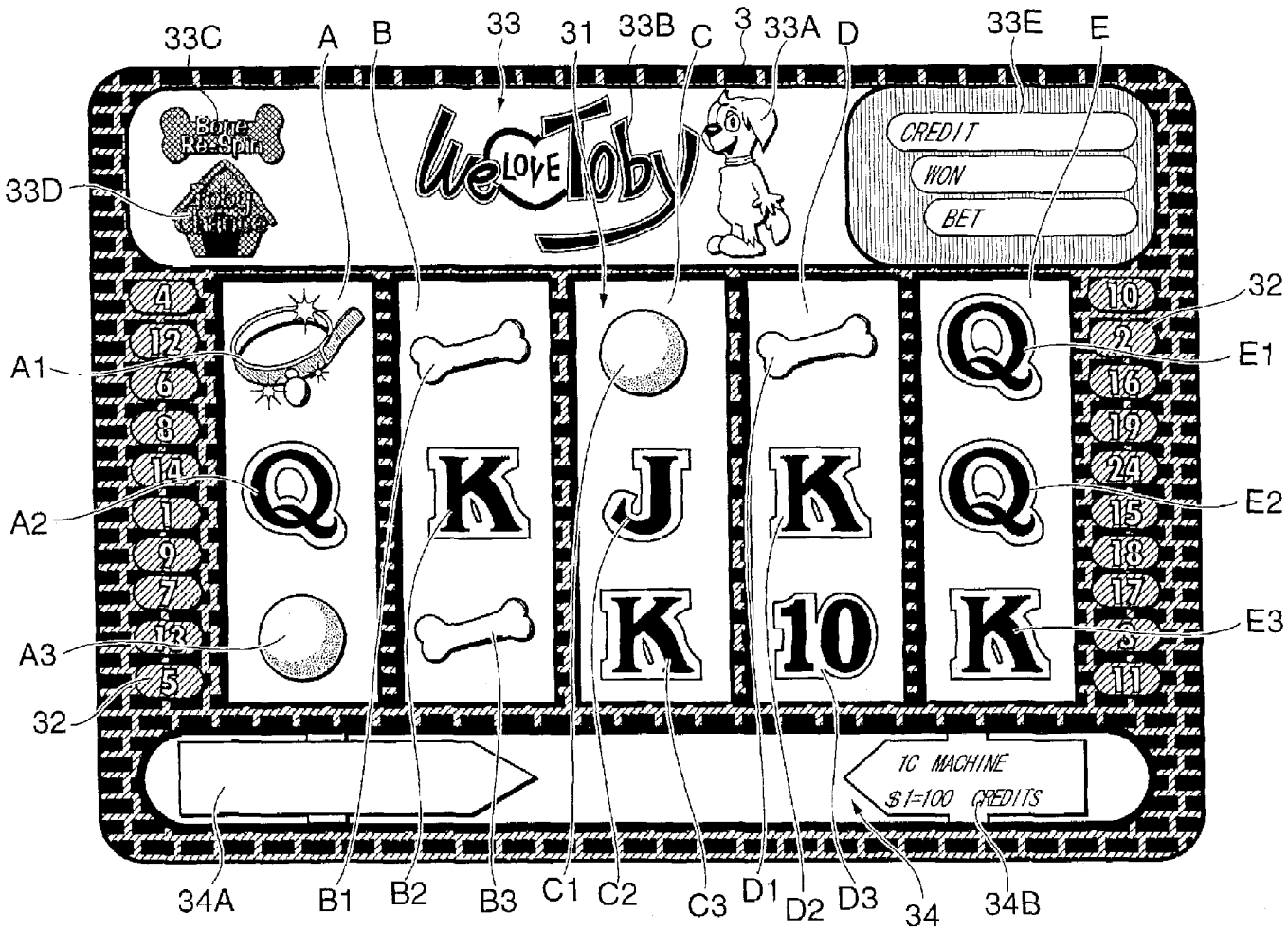
FIG. 3 is a drawing showing a display screen on a display.

FIG. 3 is a drawing showing a display screen of the display 3. In this embodiment, a display section 31, a line number display 32, an upper part display 33, and a lower part display 34 are displayed respectively in the display 3.

Fifteen display regions in total, in which a plurality of symbols are to be displayed, are provided in the display section 31 in three rows by five columns. Moreover, the turning reel images drawn on regions indicated by 'A' through 'E', in which a plurality of types of symbols are shown, are varyingly displayed, and the images are processed such that symbols being chosen upon stopping respective reels are displayed on the display regions: A1 through A3, B1 through B3, C1 through C3, D1 through D3, and E1 through E3.

On both sides of the display section 31, the line number display 32 is arranged such that a line number showing each pay line is displayed. Among line numbers displayed in the line number display 32, a line number corresponding to the pay line which a player has chosen is lighted, and a number that the player has not chosen remains unlighted.

An upper display 33 is formed above the display section 31. In the center of the upper display 33, the dog image 33A having a pet name of "Toby," a mascot of a slot machine of this embodiment, is displayed with the decoration letter image 33B of "WELOVETOBY" on its side. Moreover, on the upper left side of the upper display 33, a bone image 33C is displayed, and a doghouse image 33D is displayed on the lower side of the bone image 33C. The bone image 33C and the doghouse image 33D are lighted in the predetermined special game. Furthermore, an image of credit number is formed on the right side of the upper display 33. In the image of credit number, the number of credited coins, the number of coins having been obtained in one game, and the number of coins bet in one game are displayed.

A lower display 34 is formed under the display section 31. A letter information display 34A to display character information are formed at the left position of the lower display 34 to indicate the state, for example, when a chance and bonus games have been started. Furthermore, at the right side position of the lower display 34, a rate display 34B is formed in which a rate charged for performing 1 BET is displayed.

Figure 4:
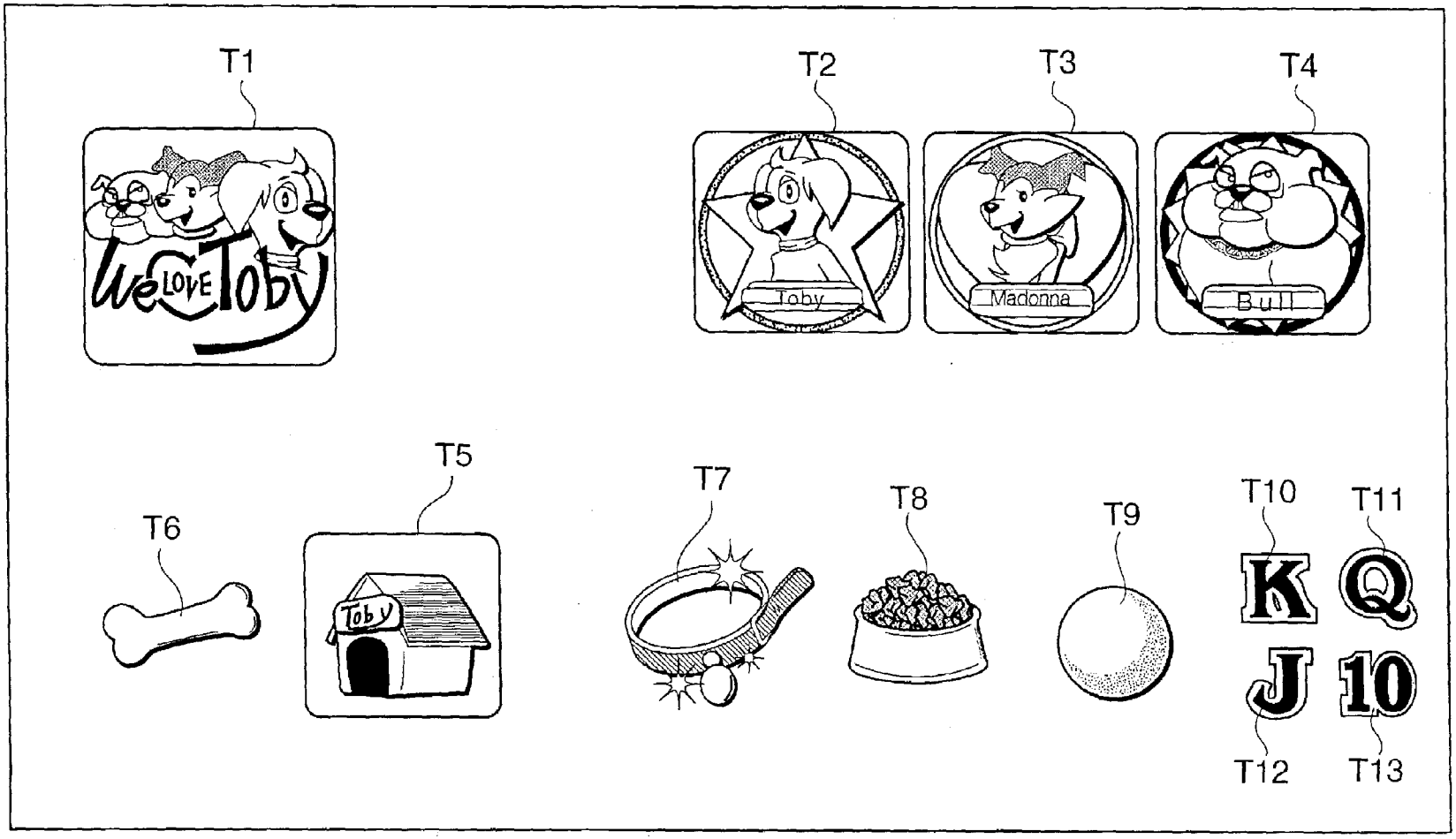
FIG. 4 is a drawing showing symbols displayed on each display region in enumeration.

FIG. 4 is a drawing to enumerate symbols displayed on each display region. As the symbols in this embodiment, there are special symbols such as a wild symbol T1, a Toby symbol T2, a Madonna symbol T3, a bull symbol T4, a doghouse symbol T5 and a bone symbol T6.

The Toby symbol T2 is a symbol of a male dog having a pet name of "Toby" used as a motif. The Toby symbol T2 is set up only in the reel image A, and made possible to be displayed only in any of display regions: A1 through A3 in which an varying display stops first. The state will be established in which it is possible to expect a bonus game because this Toby symbol T2 is displayed.

The Madonna symbol T3 is a symbol of a female dog having a pet name of "Madonna" used as a motif. This Madonna symbol T3 is set up only in the reel image E, and made possible to be displayed only in any of display regions E1 through E3 in which a varying display stops at last. When the Toby symbol T2 is displayed in any of display regions A1 through A3, a shift to the main bonus game is announced by displaying the Madonna symbol T3 in the same row as displaying the Toby symbol T2.

The bulldog symbol T4 is a symbol of a male dog having a pet name of "bulldog" set up only in the reel image E similarly as the Madonna symbol T3, and it can be displayed only in the display regions E1 through E3. When the Toby symbol T2 is displayed in any of display regions A1 through 3, a shift to a sub-bonus game is announced by displaying the bulldog symbol T4 in the same row as displaying the Toby symbol T2. For both of these main bonus and sub-bonus games, a refund rate of coins (a payment rate) becomes higher than the basic game.

The wild symbol T1 is a symbol referring to all of these "Toby", "Madonna", and "bulldog" symbols as well as a decoration character "WELOVETOBY" used as a motif. The wild symbol T1 is, so to speak, an almighty symbol, and set up in such a way that it can be considered as any of usual symbols as explained later.

Moreover, the doghouse symbol T5 is a symbol of a motif of a doghouse. When this symbol T5 is displayed in a display region, the animation in which Toby dashing out from the doghouse is displayed, making symbols in other display regions changed into the Toby symbol T2. The bone symbol T6 is a symbol of a bone as a motif, and a turning cartoon film is shown if a specified condition is satisfied. Moreover, the bone symbol T6 displayed in the main bonus game, which will be mentioned later, among bonus games has a role that changes all of them into the wild symbol T1, which is to be displayed.

Moreover, there are a collar symbol T7, a hood symbol T8, a ball symbol T9 and trump card mark symbol as a regular symbol. Card mark symbols include the King symbol T10, Queen symbol T11, Jack symbol T12 and a Number symbol T13.

Figure 5A:
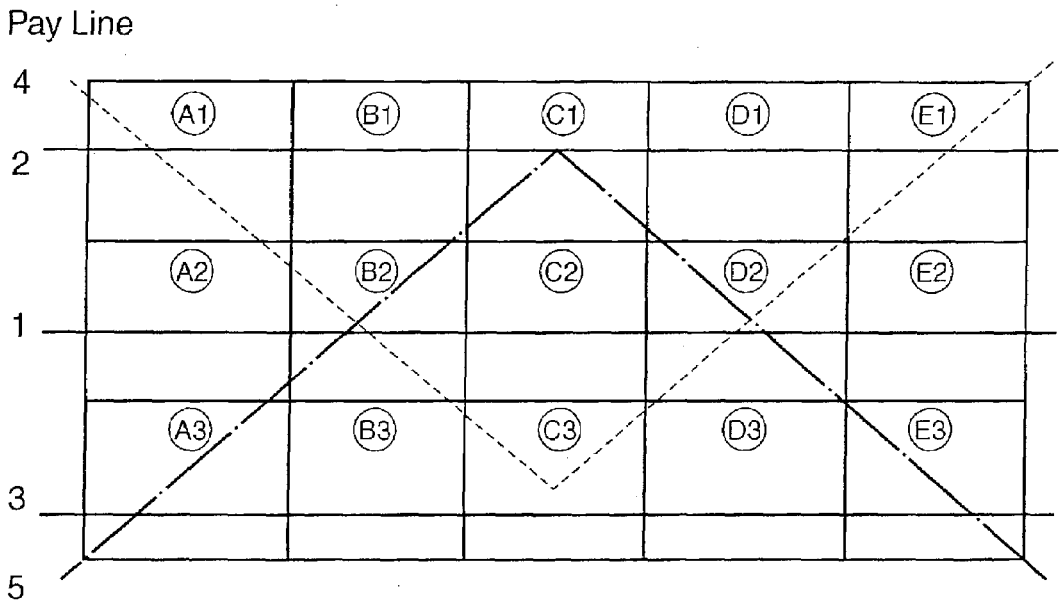
FIG. 5A is a drawing showing an example of a pay line of a slot machine.
Figure 5B:
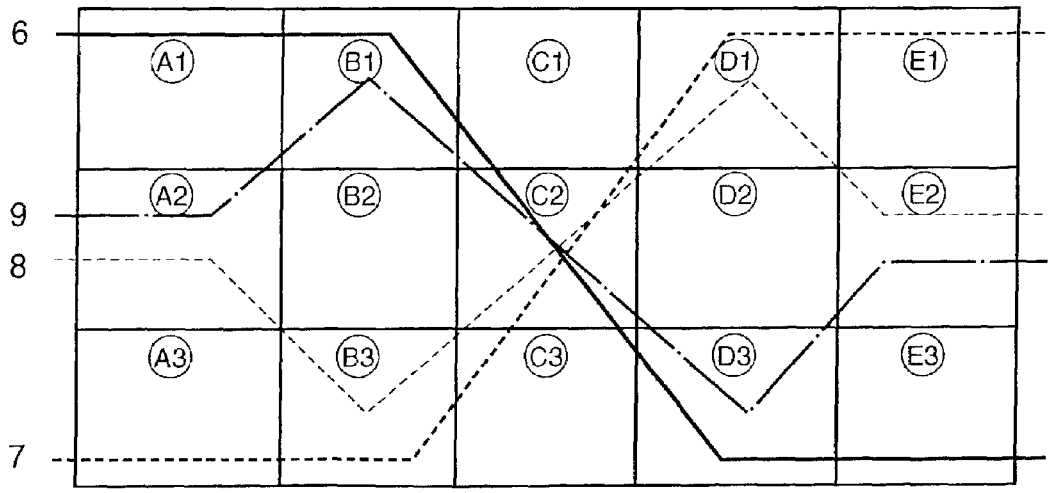
FIG. 5B is a drawing showing an example of a pay line of a slot machine.

FIGS. 5A and 5B are drawings showing an example of a pay line of slot machine 1. For better understanding, pay line symbols are shown divided into two drawings. Nine pay lines are prepared as an example as shown in each drawing. When predetermined symbols are arranged on any of these pay lines, the payout corresponding to the array contents is paid to the player. Moreover, though not shown, 11 pay lines are prepared in addition, and 20 pay lines are prepared in total. In this way, various pay lines can be provided by increasing the number of columns (e.g., three rows by five columns) in this embodiment. When a specified winning prize condition is satisfied, one kind of symbol among the normal symbols mentioned above is displayed in all display regions in one pay line, so as to announce the disbursement of the specified number of coins.

In the slot machine 1 according to this embodiment, a basic game and a bonus game are prepared for the progress of the game. In the bonus game, a main bonus game called "Madonna future" and a sub-bonus game called "Bull future" are prepared. A winning prize judgment as to whether a bonus shift condition is satisfied or not is performed in the CPU 21, and if, a bonus shift condition is satisfied, a bonus game is executed. The bonus shift condition includes the first and second bonus shift conditions, and the main bonus game will be executed when the first bonus shift condition is satisfied, and a sub-bonus game will be executed when the second bonus shift condition is satisfied. Moreover, in the slot machine 1, the coin payment rate in a bonus game is set up higher than that in the basic game. In particular, in a main bonus game, it is set up so that a coin payment rate will be higher than that in the sub-bonus game. Therefore, a player performs the basic game while hoping to shift to the main bonus game. Concrete contents of these bonus games and the judgment as to whether a bonus shift condition of these bonus games is satisfied or not, will be explained later.

Moreover, among pay lines of 20 set up in display regions A1 through A3, B1 through B3, C1 through C3, D1 through D3, and E1 through E3, the winning prize is judged based on whether the same symbols align in the pay line which is specified by a player. And, when the same symbols align with the pay line which the player specified, it is judged that a winning prize condition is satisfied, and payment of the specified number of coins is performed. In this winning prize judgment, the wild symbol T1 can be regarded as the symbol which is almighty for any symbols. Thus, the same number of coins will be paid even when only King symbol T10 and wild symbol T1 align in all display regions in one pay line in the same way as in the case where King symbol T10 aligns in all display regions in one pay line.

Moreover, a shift to the bonus game is announced to the player when the basic game is shifted to the bonus game by displaying a predetermined symbol on the display region. Specifically, when the basic game is shifted to the main bonus game of the bonus games, Toby symbol T2 is displayed in any of display regions A1 through A3, and, at the same time, Madonna symbol T3 is displayed in the display region out of E1 through E3 at the same row position as the Toby symbol T2 is displayed. Moreover, when the basic game is shifted to a sub-bonus game, Toby symbol T2 is displayed in any of display regions A1 through A3, and, at the same time, the bulldog symbol T4 is displayed in one out of display regions E1 through E3 at the same row position as Toby symbol T2 is displayed.

Furthermore, in the slot machine 1 according to this embodiment, the chance game of the present invention that is a different game is set up in addition to the basic and bonus games. The chance game is a game to raise expectation of the player to the bonus game shift. The judgment of a shift to this chance game is also made by a judgment in the CPU 21, and the shifting to the chance game is made by satisfying a specific condition in a winning prize judgment. The specific contents and judgment as to whether the specific condition for the chance game is satisfied is explained later.

Controls of such basic and bonus games are performed by the CPU 21 of the controller 20, the memory 22, the image processing circuit 23, and the display 3 in collaboration with each other.

Figure 6:
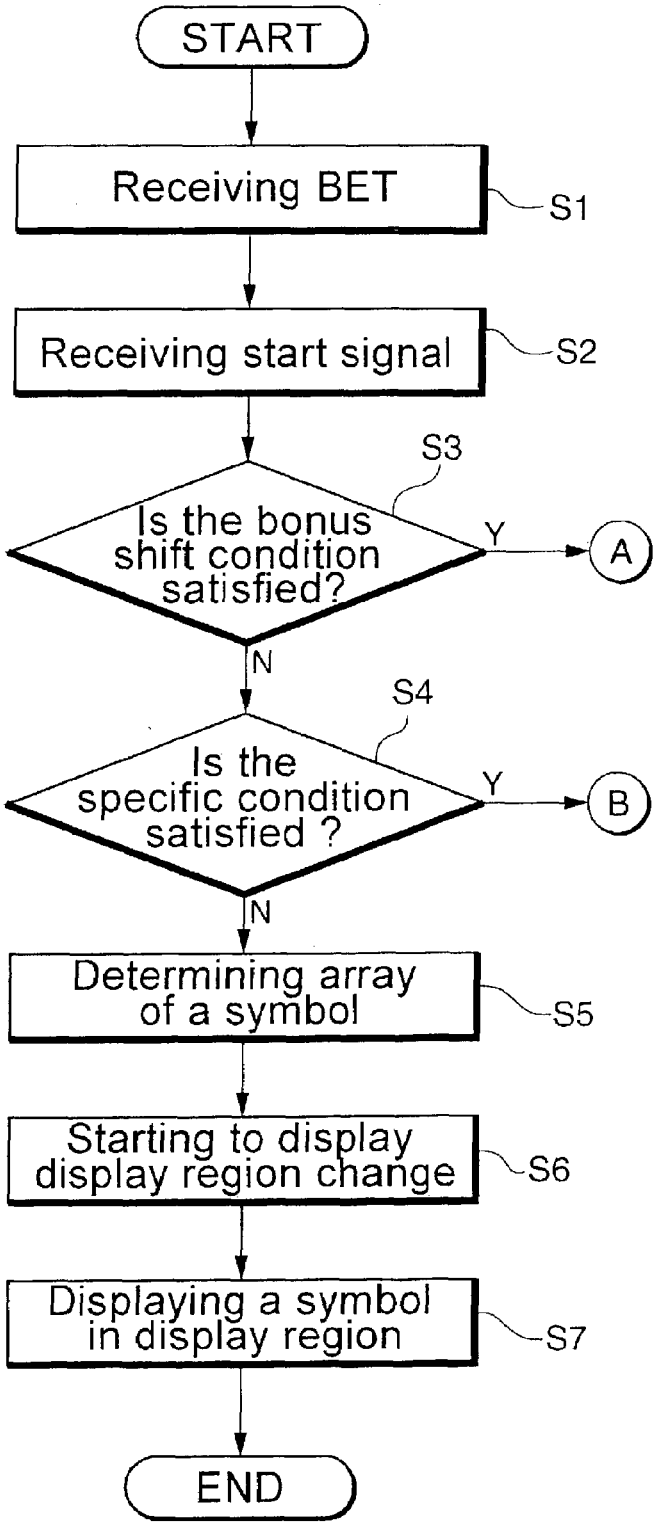
FIG. 6 is a flowchart showing a flow of basic game of a slot machine according to this embodiment.

A control method of the slot machine 1 according to this embodiment is explained next. FIG. 6 is a flowchart showing the flow of the basic game of the slot machine 1 according to this embodiment. At first, the flow of the basic game is explained in referring to FIG. 6 as the judgment of performing the bonus game is mentioned.

When the slot machine 1 is operated, the CPU 21 accesses the memory 22 and transfers the information on the basic screen of the slot machine 1 such as the frames forming the display region to the image processing circuit 23. In the image processing circuit 23, after the information is stored in Video RAM, the display 3 shows it. Thus, the slot machine 1 is in a state where the player can perform the slot game. Because the CPU 21 executes a module about the slot game of a program stored in the memory 22, the following processing is performed. When the slot machine 1 is operated, a state is established where the basic game is performed as the slot game.

In step S1, the CPU 21 of the controller 20 waits for BET by the player. BET can be performed with the remaining credit, and the player specifies the number of BET by using any of the BET button 12, the MAXBET button 13, and the REPEATBET button 14.

The player pushes the start button 11 after BET is completed (S2). Then, the CPU 21 judges whether the bonus shift condition is satisfied before variable display is made so as to show how the reel turns (S3). Moreover, a similar judgment is performed without pushing the start button 11 when the player pushes the MAXBET button 13 or the REPEATBET button 14. In this judgment, a random number value provided by the program stored in the memory 22 is used.

For example, when a random number is generated in a range of integers 0–400 and a random number value of 1 is acquired as a random number value, the player can enter the main bonus game because the second bonus shift condition is satisfied. When a random number value of 100 or 200 is acquired as a random number value, then the player can enter the sub-bonus game because the first bonus shifting bonus condition is satisfied. Moreover, a lottery on the basis of such a random number value may be performed in any timing. For example, a lottery may be drawn when the start button 11 is pushed, whenever the BET button 12 is pushed, or after the reel images A through E have been variably displayed.

After a judgment is made as to whether a bonus shift condition is satisfied, a judgment as to whether a specific condition is satisfied is performed successively (S4). The judgment as to whether the specific condition is satisfied can be made by generating a plurality of random numbers similarly as in the judgment of the bonus shift condition and using a random number value acquired from these random numbers. For example, it is judged that the specific condition is satisfied when a random number is generated in a range of integer 0–100 and a random number value of 100 is obtained.

After the judgment of the bonus shift condition and the specific condition is made in this way, an array of symbols to notify the player about a result of those judgments is decided in the CPU 21 (S5).

Figure 10:
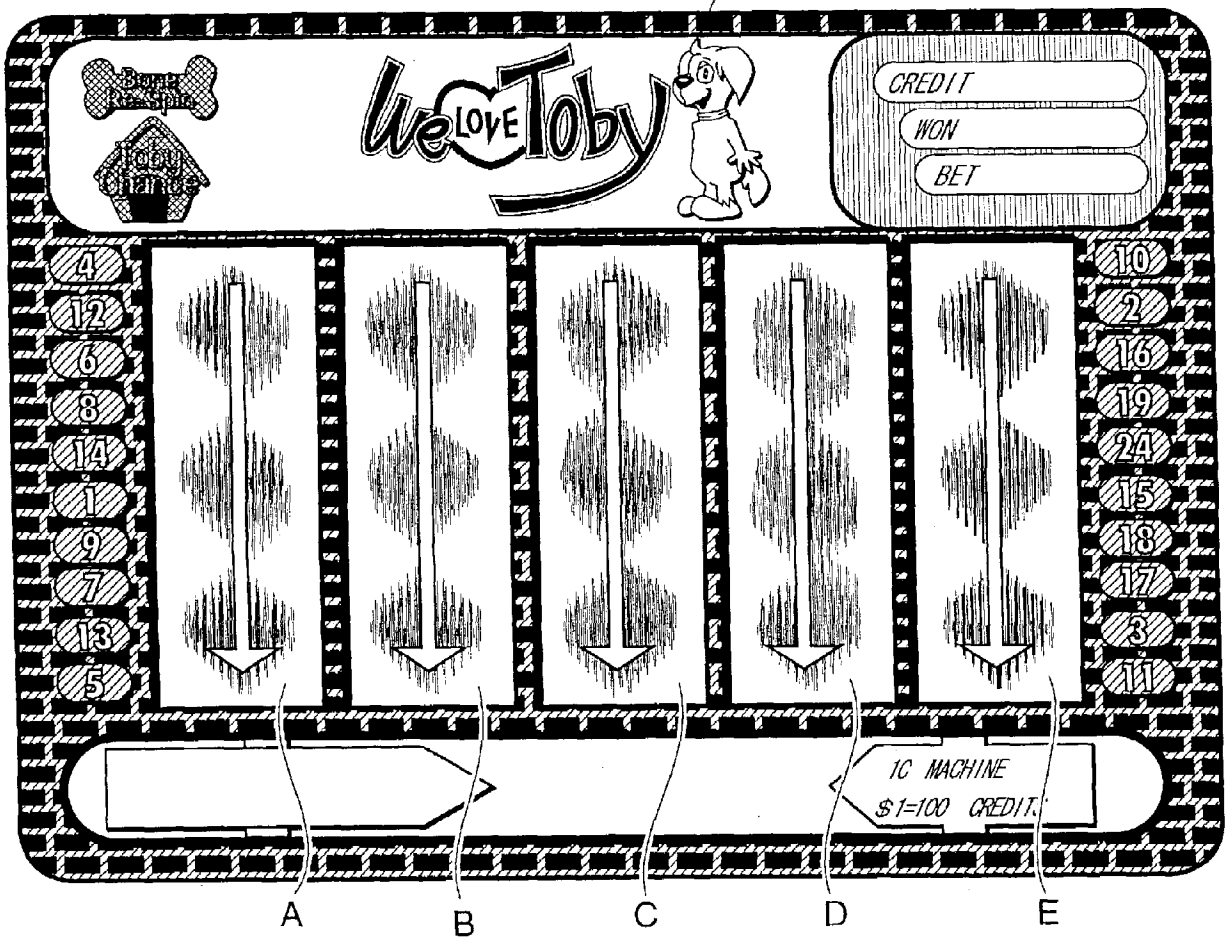
FIG. 10 is a drawing showing a display screen of a display in the state where each reel image is varyingly displayed.

If an array of a symbol is determined, as shown in FIG. 10, displaying of display regions is started so as to variably display reel images A through E in display 3 (S6). In the CPU 21, the image processing circuit 23 is controlled to perform the image processing as if a real reel turned. And, a symbol decided beforehand is displayed in each display region by stopping reel images A through E individually in this order, for example, as shown in FIG. 3(S7). And, the player watches this display and can know the result of the basic game, and, when the same normal symbols align within the pay line which the player has specified, then, disbursement of the specified number of coins is performed.

Figure 7:
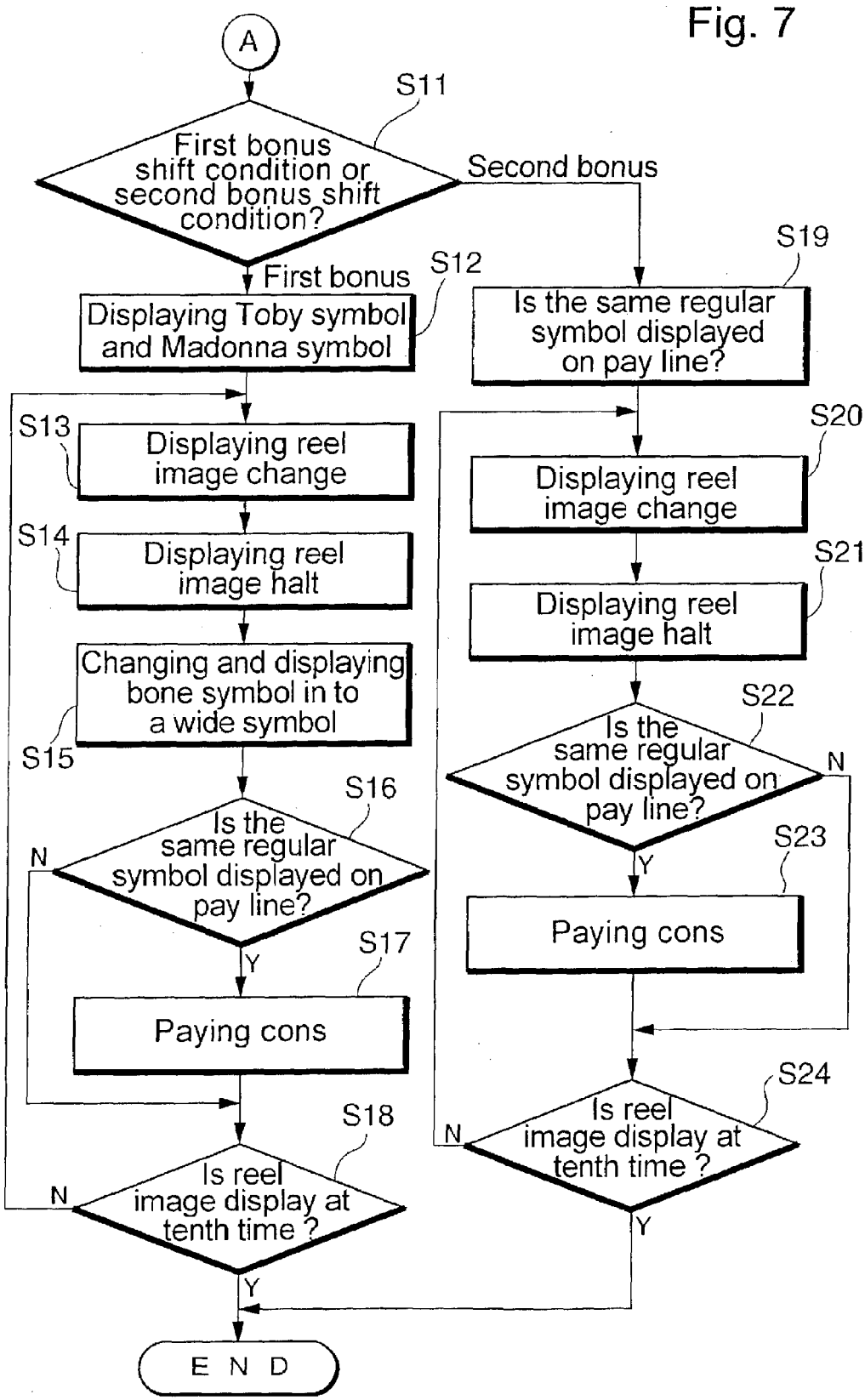
FIG. 7 is a flowchart showing a flow of a bonus game of a slot machine according to this embodiment.
Figure 9:
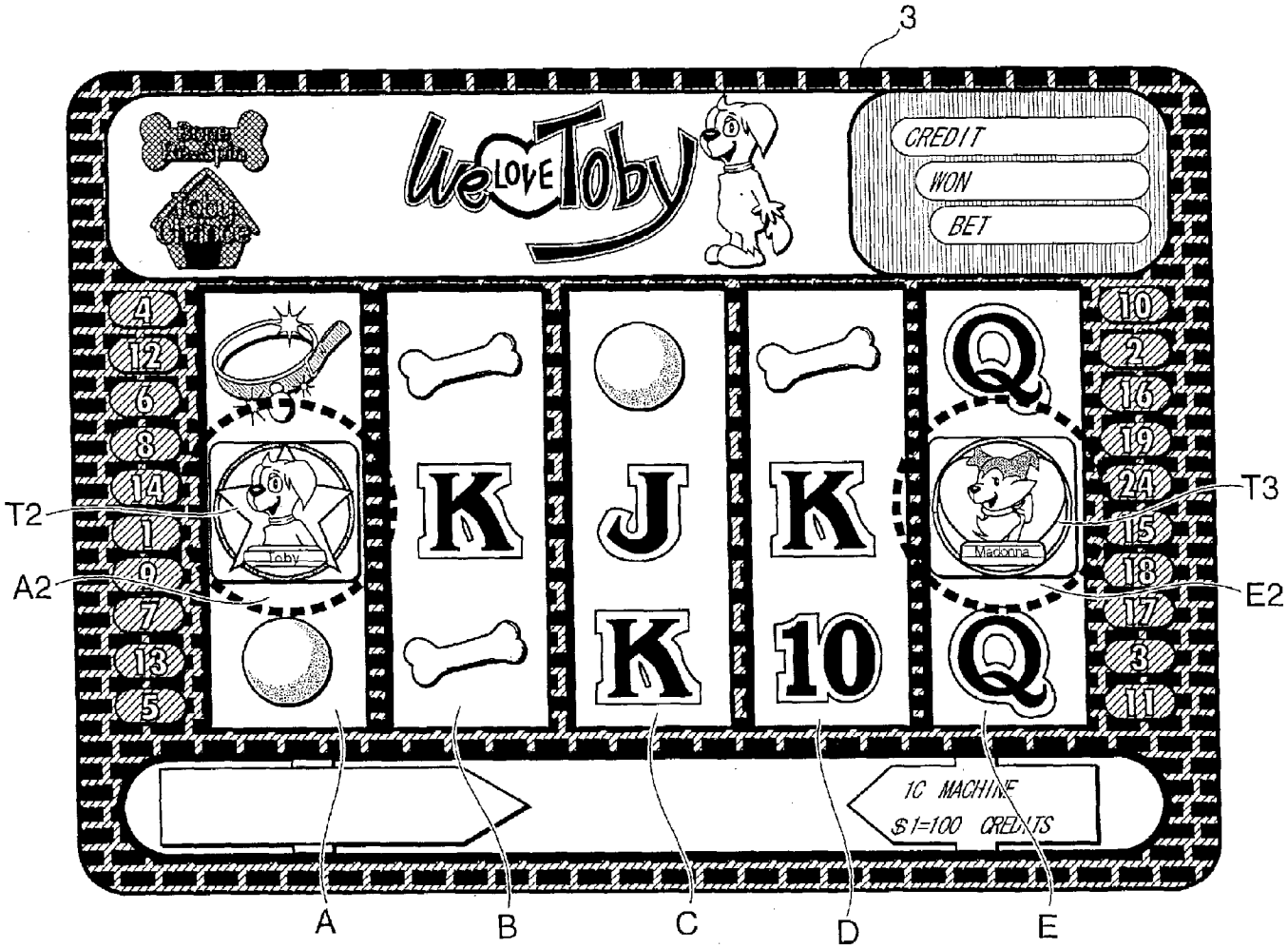
FIG. 9 is a drawing showing a display screen of a display showing a symbol array to announce a start of a main bonus game.

Then, a flow of the bonus game is explained in referring to FIG. 7. The judgment as to whether either the first bonus shift condition or the second bonus shift condition is satisfied is made if a bonus shift condition is satisfied in a bonus shift judgment by a lottery of a random number value in step S3 in the basic game (S11). As a result, if it is judged that the first bonus shift condition is satisfied, the game is shifted to the main bonus game, and, if it is decided that the second bonus shift condition is satisfied, the game is shifted to the sub-bonus game. When the game is shifted to the main bonus game, the Toby symbol T2 is displayed in any of display regions A1 through A3 where the varying display stops first, for example, as shown in FIG. 9, in display region A2. Successively, the Madonna symbol T2 is displayed in display region E2 in the same row position of the Toby symbol T2 among display regions E1 through E3 where the varying display stops afterwards (S12). In this way, an announcement that the main bonus game is performed is made to the player. When the game is shifted to the main bonus game, reels images A through E start the varying display automatically (S13). Free spin is performed here, and the reel images A through E are stopped and shown in turn successively (S14). When all reel images A through E are stopped and shown, any of the Wild symbol T1, the bone symbol T6 and the regular symbols are displayed in the display region A1 through A3, B1 through B3, C1 through C3, D1 through D3, and E1 through E3.

When the bone symbol T6 is displayed by the main bonus game in each display region, display of the bone symbol T6 changes to become the wild symbol T1 (S15). Many bone symbols T6 are capable of being displayed in the display region, and, when the main bonus game begins, many of the same symbols are displayed in a pay line as the bone symbol T6 changes into the wild symbol T1. And, the judgment as to whether the same normal symbols are shown on the pay line is made (S16), and, if they are displayed, the number of coins corresponding to the types of the symbol which aligns with the pay line are paid (S17). Moreover, when the same normal symbol is not shown in the pay line, a coin is not paid, but most coins may be refunded in the main bonus game.

Because free spin is repeated ten times in total in this main bonus game, it is judged whether display is in the tenth in a reel image variation (S18). As a result, when the tenth spin is not made, the process is returned to step S13 and display is shifted to varying display of reel images. Moreover, when the tenth display is made after the varying display of reel images, the main bonus game is terminated such that the game shifts to the basic game.

On the other hand, for example, when the second bonus shift condition is judged to be satisfied in step S11 and the game is shifted to the sub-bonus game, the Toby symbol T2 is displayed in any of display regions A1 through A3 where the varying display stops at first such that a still image appears, for example, in display region A2. Successively, Bulldog symbol T4 is displayed in display region E2 in the same row of Toby symbol T2 among display regions E1 through E3 where the varying display stops afterwards (S19). In this manner, an announcement that the sub-bonus game is performed is made to the player. When the game is shifted to the sub-bonus game, the reel images A through E start to vary automatically as in the main bonus game (S20). Free spin is performed here, and successively, the reel images A through E are stopped and still images are shown in turn (S21). When all the reel images A through E are stopped and shown in a stationary manner, any of the Wild symbol T1, the bone symbol T6 and the regular symbols are displayed on the display regions A1 through A3, B1 through B3, C1 through C3, D1 through D3, and E1 through E3. In the sub-bonus game, even if the bone symbol T6 is displayed similarly as in the main bonus game, each displayed image does not change into the Wild symbol T1 and remains as it is. Therefore, the number of coins to be paid is smaller compared to the case of the main bonus game. In such a manner, when the reel image is stopped and appears, it is judged whether the same regular symbols are shown in the pay line (S22), if it is determined that they are shown, the number of coins corresponding to the types of the symbols aligned in the pay line are paid (S23). Moreover, when the same regular symbols are not shown in the pay line, no coins are paid. However, it is rare that no coins are paid in the main bonus game.

Since free spin is repeated ten times in total in this sub-bonus game similarly as in the main bonus game, it is judged whether the reel image varying display is in the tenth spin (S24). As a result, when the tenth spin is not made yet, the game returns to step S23 to shift to the reel image varying display. Moreover, when the reel image variation display reaches the tenth spin, a sub-bonus game is terminated to shift to the basic game.

Figure 8:
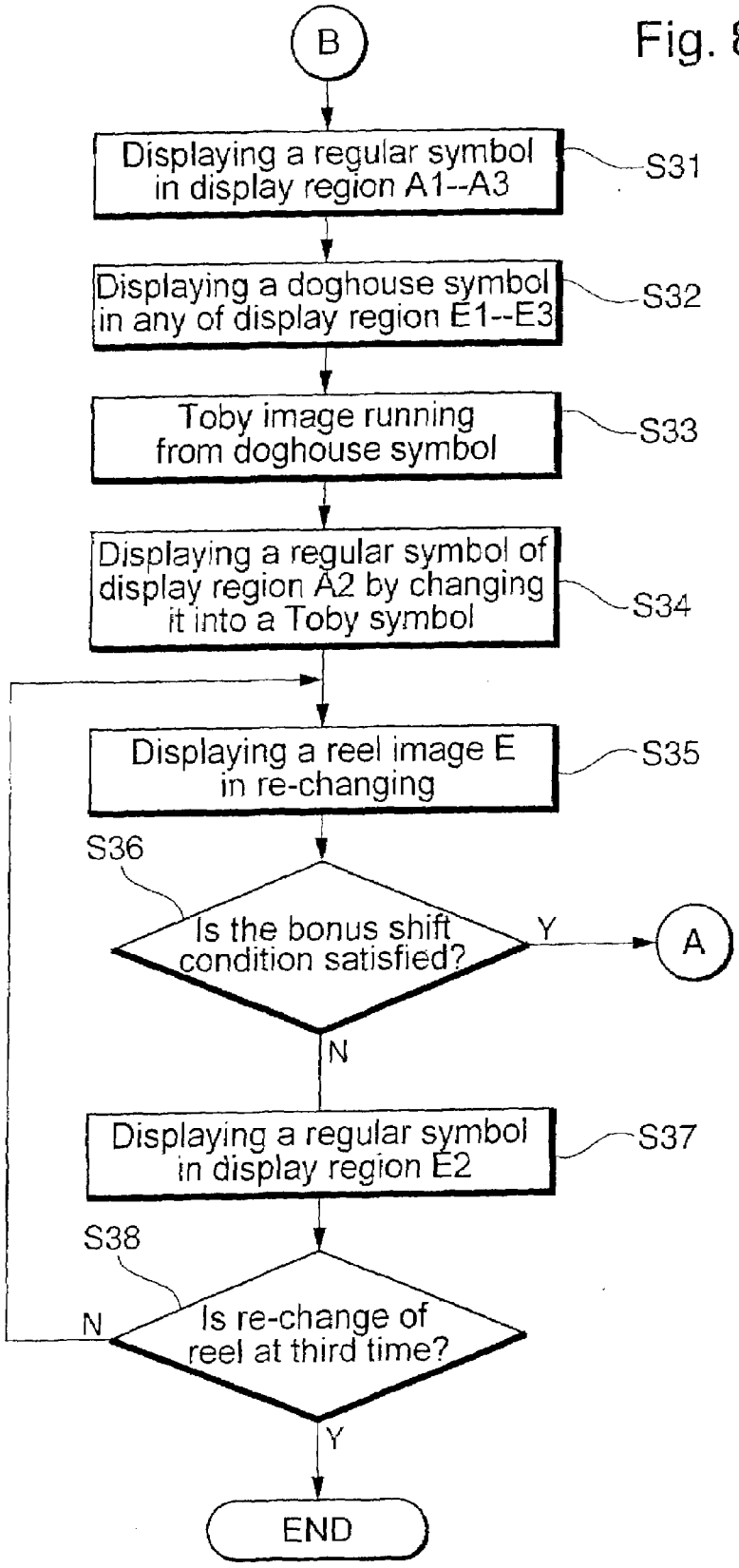
FIG. 8 is a flowchart showing a flow of a chance game of a slot machine according to this embodiment.
Figure 11:
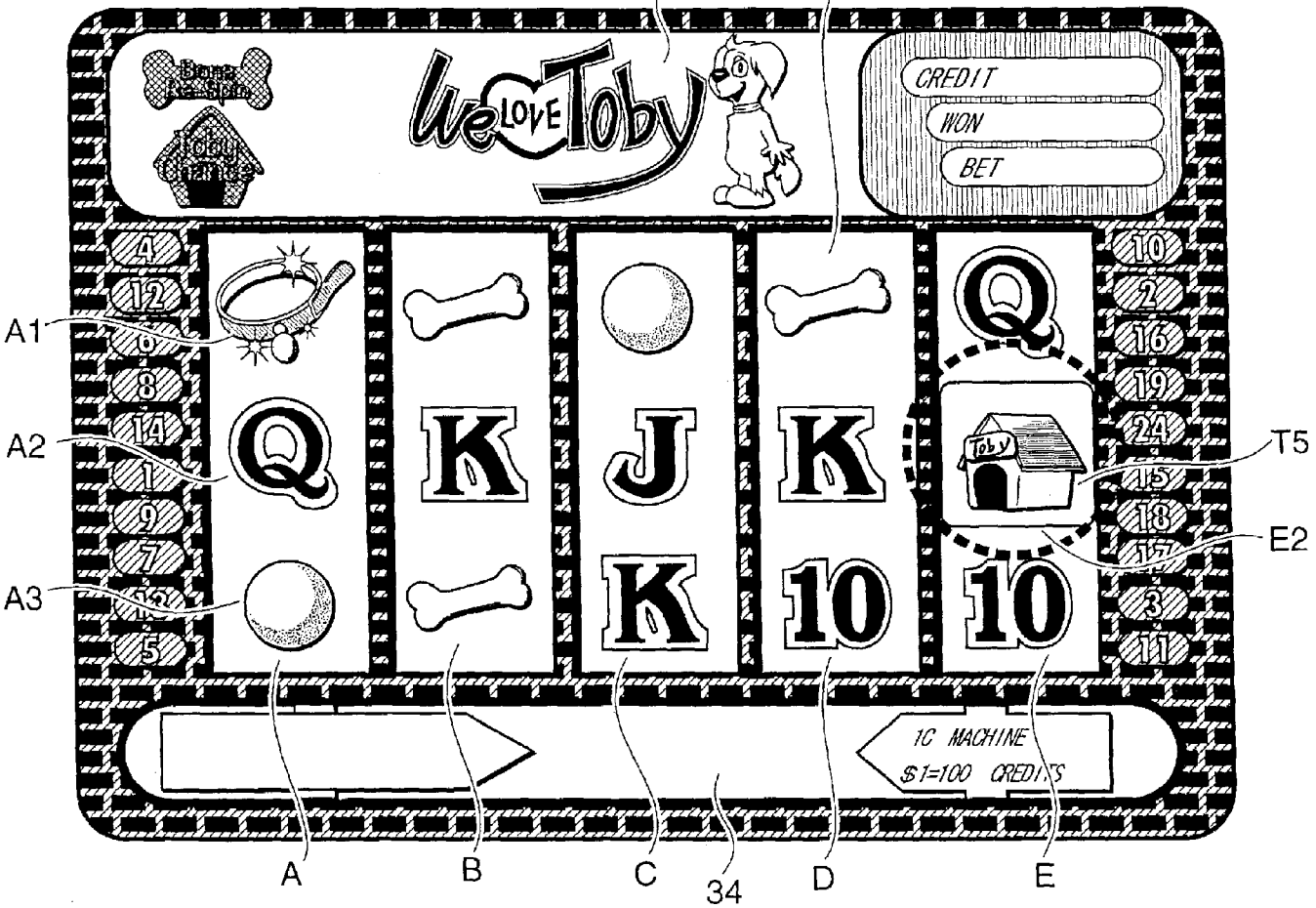
FIG. 11 is a drawing showing a display screen of a display when a doghouse image is displayed in the display region E2.

The flow of the chance game is explained next in referring to FIG. 8. If it is judged that a specific condition is satisfied in step S4 in the basic game, the CPU21 controls the image processing circuit 23 for display, as shown in FIG. 11, a regular symbol other than the Toby symbol T2 displayed in any of all display regions A1 through A3 where the varying display stops at first (S31). Then, the reel images B through D are stopped, and, the doghouse symbol T5 is displayed in any one of the display regions E1 through E3 where the varying display is stopped at last (e.g., the display region E2 in FIG. 11) (S32). The Doghouse symbol T5 is displayed in the display region where the varying display stops at last so that the player can expect a shift to the chance game until the varying display stops, thereby raising the attractiveness of the game.

Figure 12:
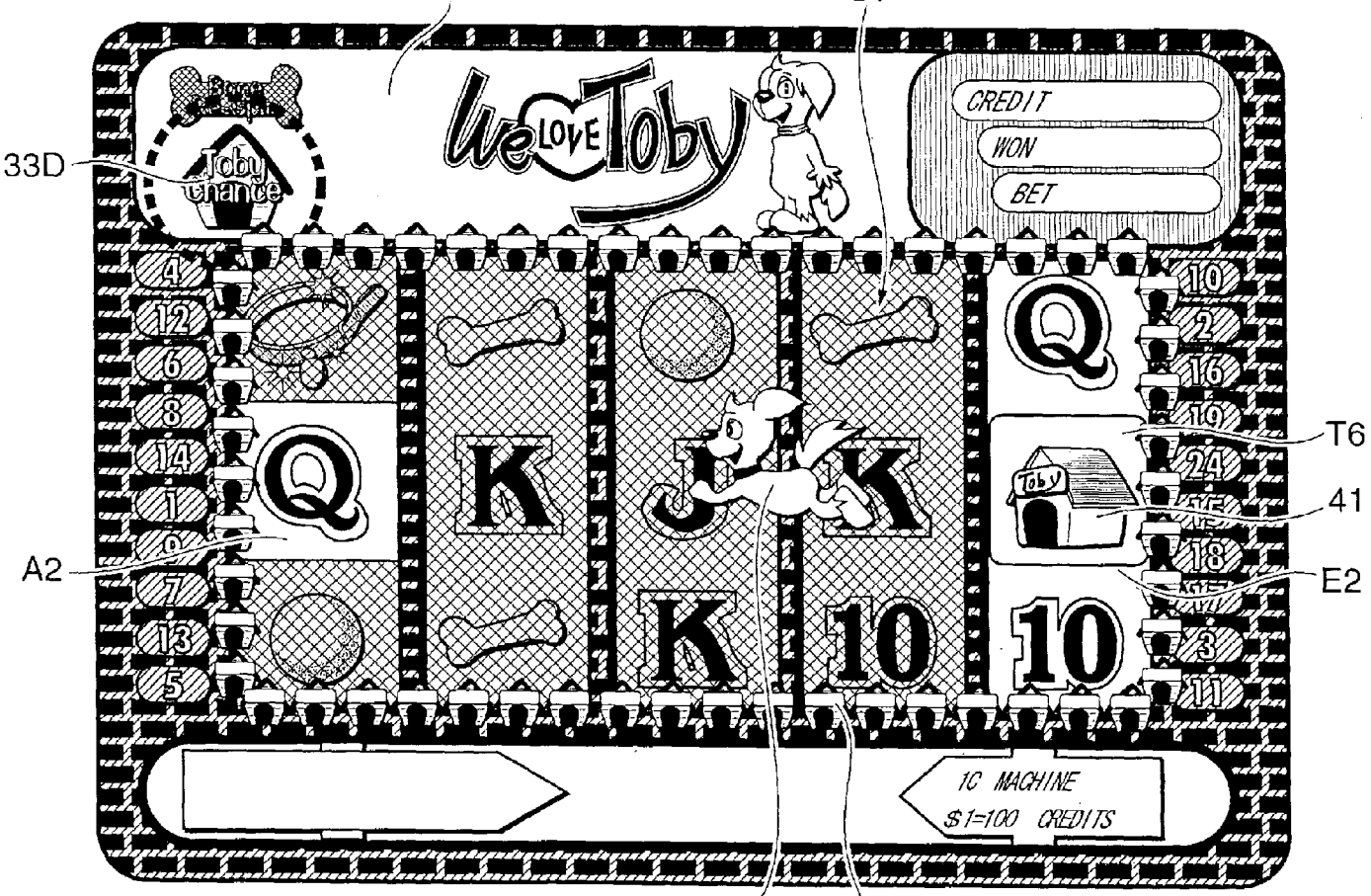
FIG. 12 is a drawing showing a display screen of a display in the state where a Toby image starts to run toward the display region A2 from a doghouse image.

When the Toby symbol T2 is not displayed in any of all the display regions A1 through A3 where the varying display stops at first, and the doghouse symbol T5 is displayed on the display region E2 where the varying display stops at last, then, as shown in FIG. 12, a Toby image 42 of a motif of Toby running toward the display region A2 from the doghouse image 41 in the doghouse symbol T5 is displayed (S33). At the same time, the display regions A1, A3, B1 through B3, C1 through C3, D1 through D3 with little relevance to the chance game are displayed in dark tone. Moreover, the doghouse image 41 in the upper display section 33 is lighted for display. In this way, a shift to the chance game is announced to the player. Because the chance game is a game with high probability to shift to the bonus game, the player who has watched that this varying display stops feels aroused when the game is shifted to the chance game and has a feeling of expectation to play the chance game.

Figure 13:
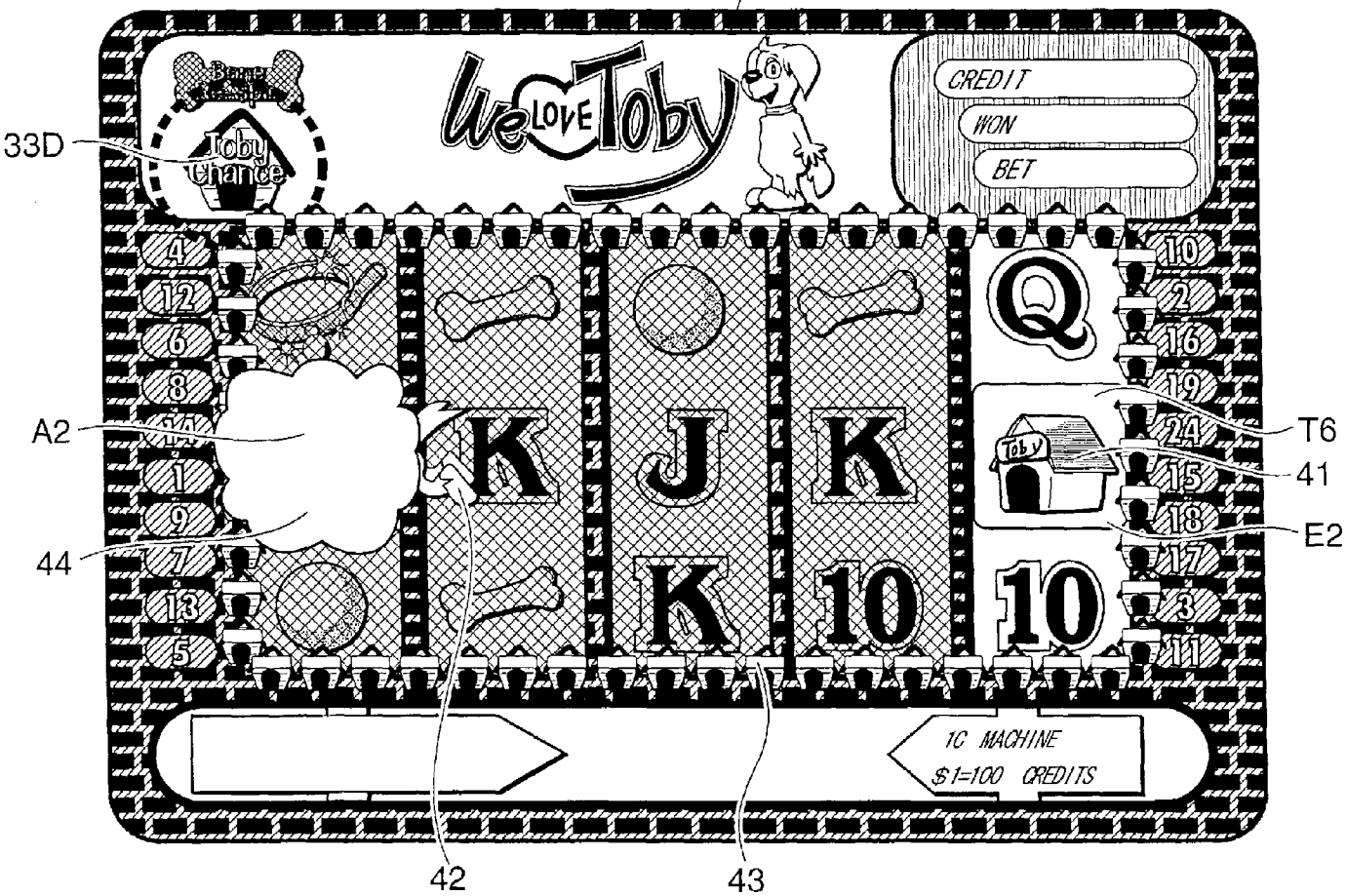
FIG. 13 is a drawing showing a display screen on a display in the state where a Toby image jumps into the display region A2 with a smoke image being displayed.
Figure 14:
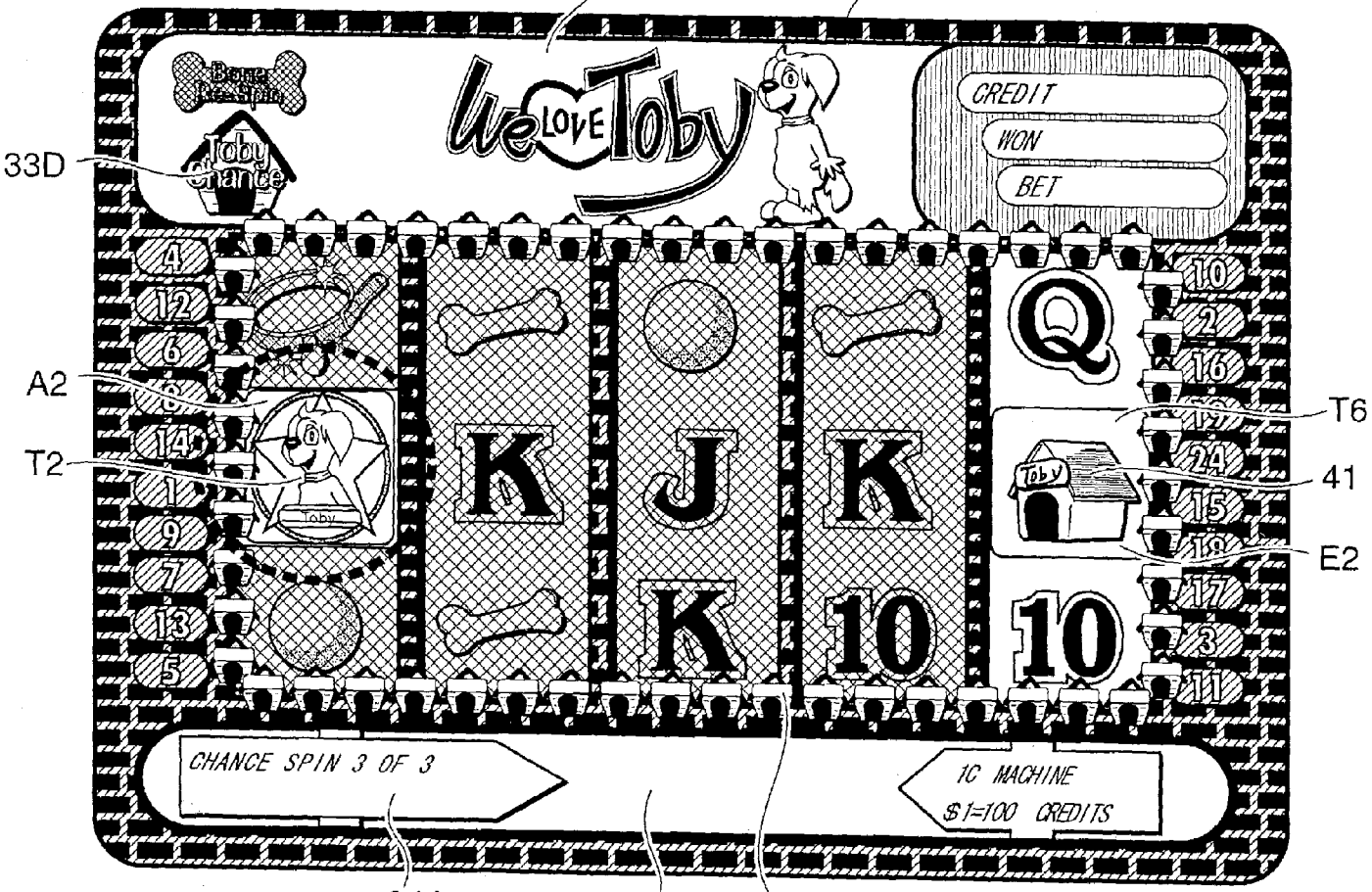
FIG. 14 is a drawing showing a display screen on a display in the state where a Toby symbol is displayed in the display region A2.
Figure 15:
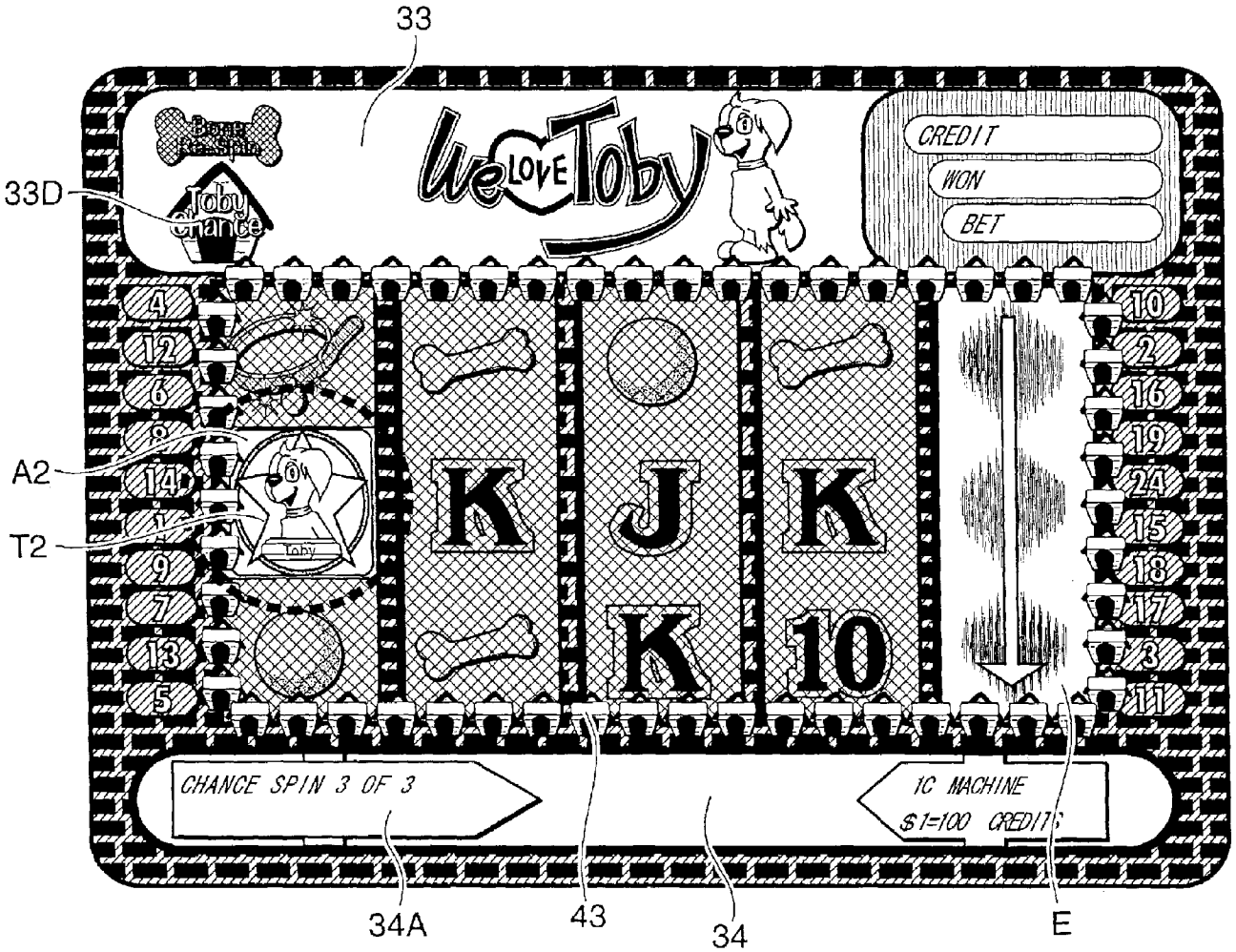
FIG. 15 is a drawing showing a display screen on a display in the state where a reel image E is varyingly displayed after a Toby symbol has been displayed in the display region A2.

If the Toby image 42 starting to run toward the display region A2 is displayed, the varying display stops where the Toby image 42 jumping into the display region A2 is displayed afterwards as shown in FIG. 13. In the display region A2, a smoke image 44 that is associated with smoke being caused by the jumping Toby image 42 is displayed to cover a regular symbol displayed on the display region A2. Then, a symbol displayed in the display region A2 which is a display region at the same row position as the display region E2 where the doghouse symbol T5 is displayed is changed from a regular symbol to the Toby symbol T2 as shown in FIG. 14 (S34). Because the start of the bonus game is announced by aligning the Toby symbol T2 and the Madonna symbol T3 at the same row position, the Toby symbol T2 is displayed on the display region A2 first. If the Toby symbol T2 is displayed, the rightmost side reel image E is variably displayed again as shown in FIG. 15 (S35). This re-varying-display is repeated for maximum three times, the chance game is performed for maximum three times, and a lottery is performed to determine whether the bonus shift condition is satisfied (S36). In this instance, "CHANCE SPIN 3OF3" is displayed in the character information display 34A in the lower display 34, to announce the player that chance games are performed for three times at maximum, and the number of remaining times to play the chance games.

A lottery of a bonus shift condition in the chance game is configured in such a way that the range of random numbers to occur is made small, and the first and second bonus shift conditions will be satisfied in higher probability than the bonus shift condition is satisfied in the basic game.

Figure 16:
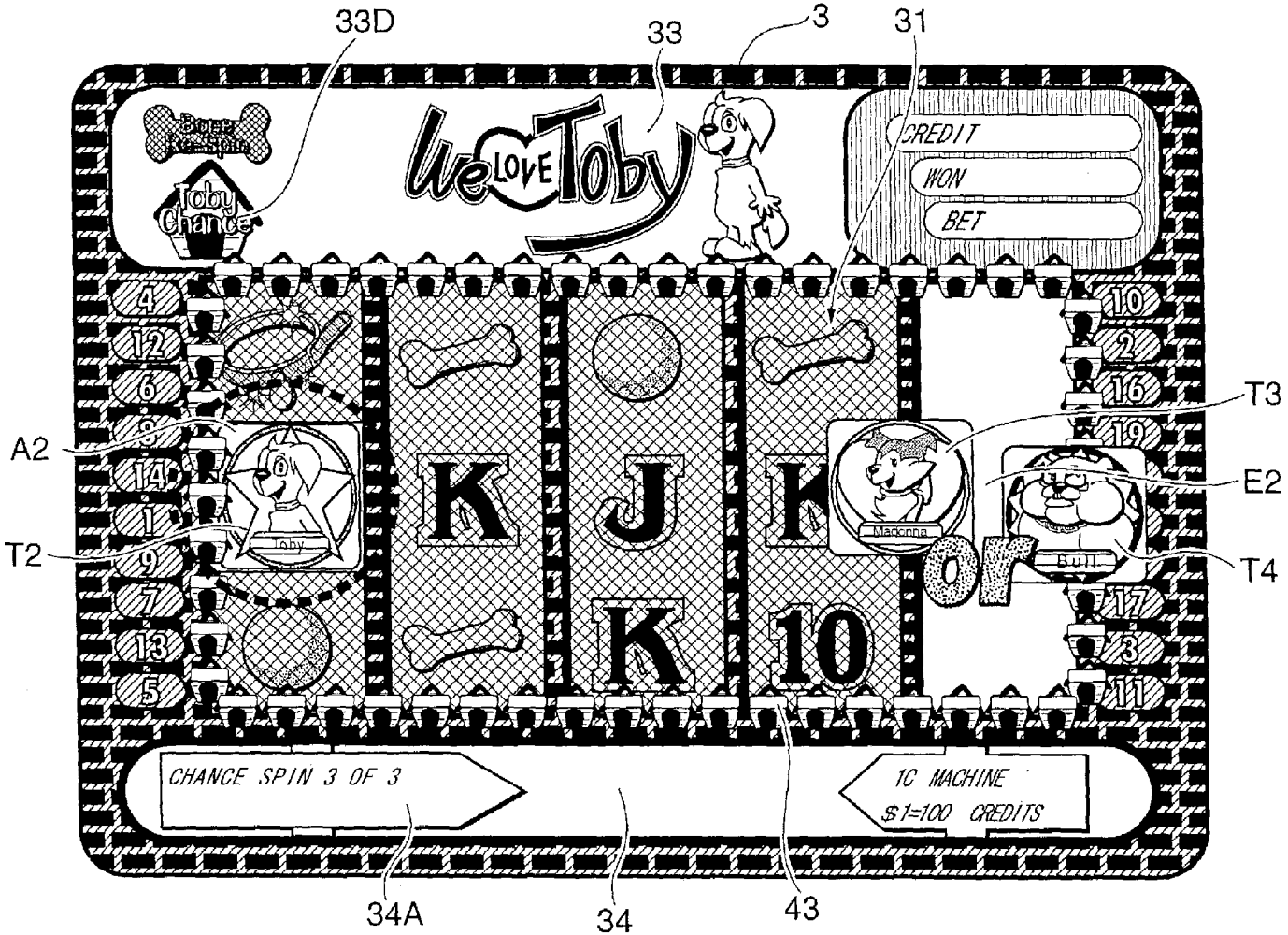
FIG. 16 is a drawing showing the display screen on the display where a Madonna symbol or Bulldog symbol is displayed in a display region.

When the first bonus shift condition is satisfied in the first chance game, as shown in FIG. 16, the Madonna symbol T3 is stopped and appears in the display region E2, the game is shifted to the main bonus game, and the chance game is finished. Moreover, when the second bonus shift condition is satisfied, the bulldog symbol T4 is stopped and appears in the display region E2, the game is shifted to the sub-bonus game, and the chance game is finished. If neither of these conditions is satisfied, a regular symbol is displayed in the display region E2 (S37) so as to announce to the player that there is no shift to the bonus game. Then, it is judged whether this chance game is in the third time (S38).

Because this reel re-varying-display is the first one, it is returned to the second reel re-varying-display (S35). The second chance game starts, and the rightmost reel image E starts the varying display. A regular symbol is stopped and appears in the display region E2, then, in the rightmost side reel image E, the variable display is again started successively. In this instance, the display of "3OF3" changes into the display of "3OF2" in the character information display 34A to announce the player that it is in the second chance game. And, when a lottery of the bonus game is drawn similarly as in the case of the first chance game, and when the first bonus shift condition is satisfied, the Madonna symbol T3 is stopped and appears in the display region E2 so that the game is shifted to the main bonus game. Moreover, when the bulldog symbol T4 is stopped and appears in the display region E2, and the game is shifted to the sub-bonus game when the second bonus shift condition is satisfied, and when neither bonus shift condition is satisfied, a regular symbol is stopped and appears in the display region E2, and successively the rightmost reel image E is displayed varyingly again to perform the third chance game. At this time, the display of "3OF2" in the character information display 34A changes to display of "3OF1" to announce that it is the third time, namely the last chance game.

If the first and second bonus shift conditions are satisfied by the last chance game, according to the flow, the game is shifted to the main bonus game and the sub-bonus game respectively. Moreover, if neither bonus shift condition is satisfied, the chance game is finished so that the game is shifted to the basic game.

Figure 17:
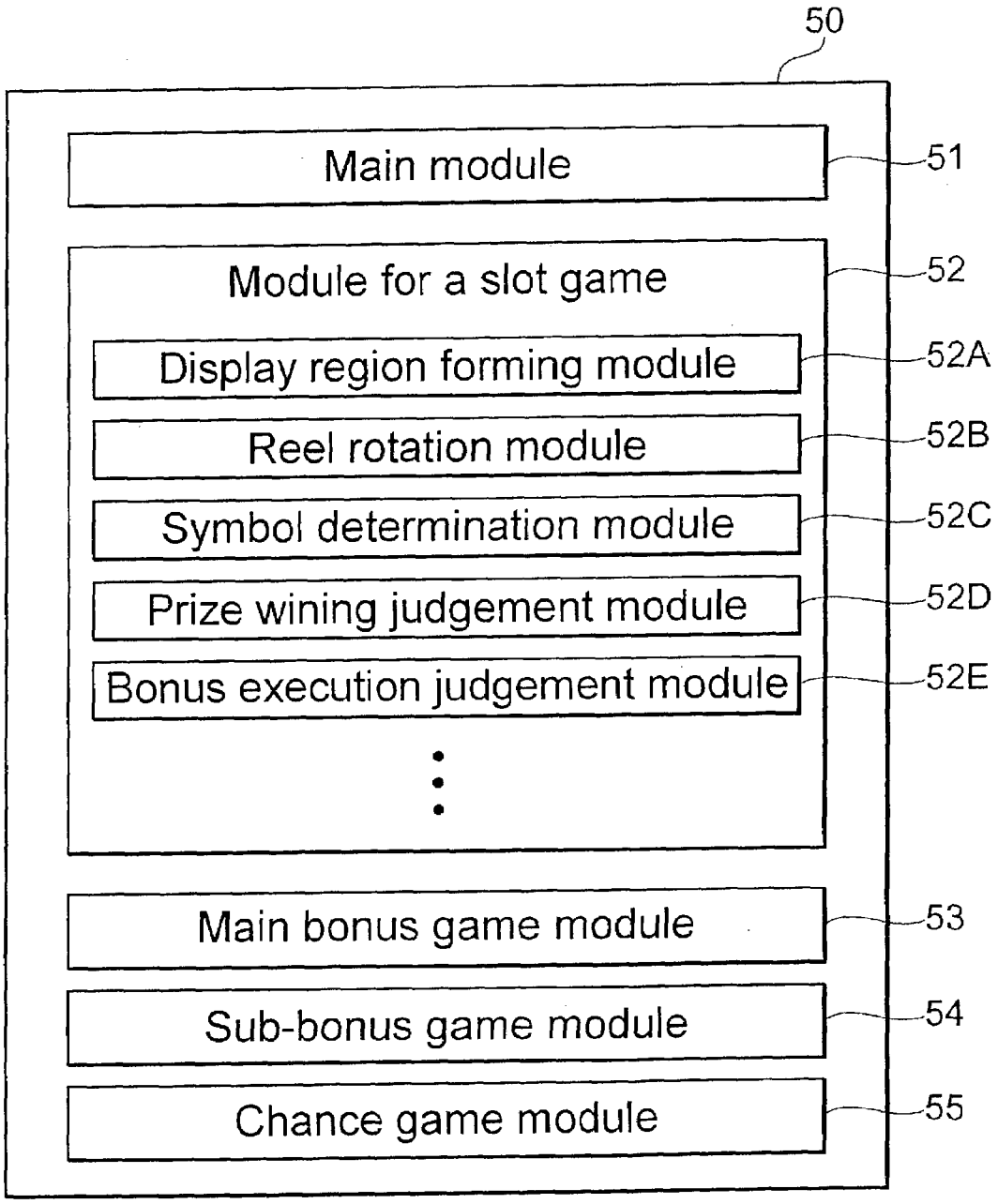
FIG. 17 is a drawing of configuration showing each module of a program of the present invention.
Figure 18:
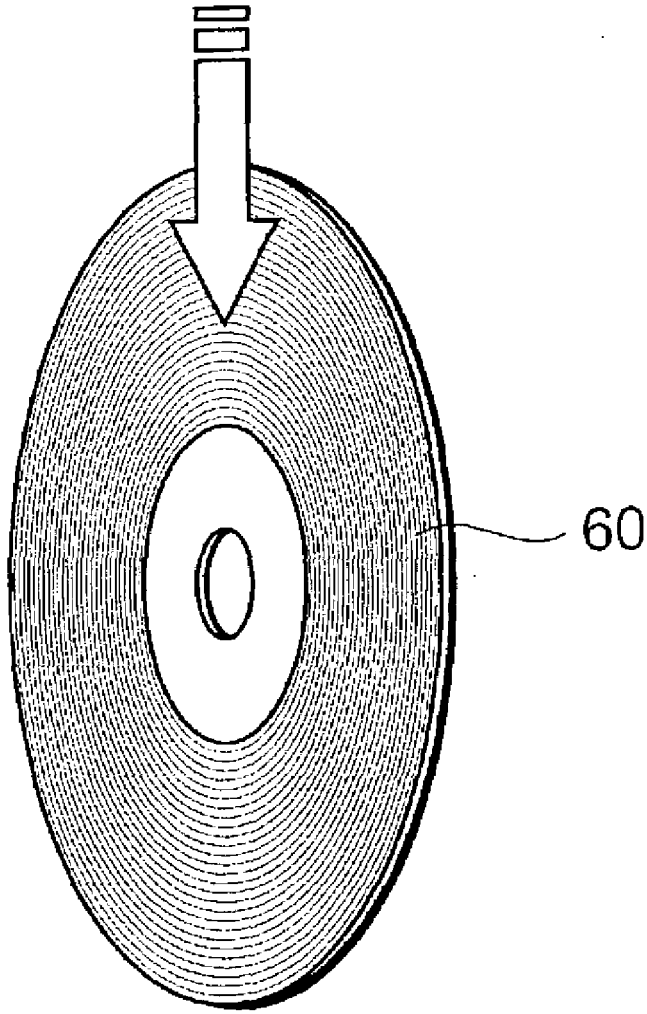
FIG. 18 is a drawing showing the recording medium in which a program as shown in FIG. 17 is recorded that can be read by the computer (CD-ROM).

Next, a preferred embodiment of the program and a recording medium readable by the computer that records the program according to the present invention are explained in referring to FIGS. 17 and 18.

FIG. 17 is a drawing showing each module of program 50 of this embodiment, and FIG. 18 is a drawing showing CD-ROM (a recording medium) 60 in which this program 50 is written.

The program 50 comprises a main module 51 supervising processing, and a module 52 for slot games relating to the processing of the basic slot game, a main bonus game module 53 relating to the processing of the main bonus game, and a sub-bonus game module 54 relating to the processing of the sub-bonus game, and a chance game module 55.

Furthermore, the module 52 for slot games comprises, at least, a display region forming module 52A, a reel turning module 52B, a symbol determination module 52C, a winning prize judgment module 52D and a bonus execution judgment module 52E.

The display region formation module 52A forms a plurality of display regions where symbols are displayed on the display 3. The reel turning module 52B variably displays reel images A through E on the display 3. The symbol determination module 52C determines the symbol to be displayed in each display region based on a random number value. The winning prize judgment module 52D judges a winning prize based on an array of symbols displayed in each display region.

The bonus execution judgment module 52E judges whether the main bonus game or the sub-bonus game is performed based on a random number value. Because a computer executes each module, it is possible to realize each processing of FIGS. 7 and 8 in the slot machine 1.

The module 53 for the main bonus game executes the main bonus game as mentioned above, and the computer executes this module, thereby enabling the processing of the main bonus game. Moreover, the module 54 for the sub-bonus game executes the sub-bonus game, and the computer executes this module, thereby enabling each processing of the sub-bonus game in the slot machine 1. The module 55 for the chance game executes the chance game, and the computer executes this module, thereby enabling each processing of the chance game in the slot machine 1.

In this way, it is possible to realize the game similar to that of the slot machine 1 by installing the program 50 being obtained as a carrier wave via a communications network of the Internet, or from a medium such as a CD-ROM 60 into various computers such as a personal computer and a personal digital assistant (PDA: Personal Digital Assistants). In other words, a development game is realized that can shift from the basic slot game to a game containing a main bonus game, a sub-bonus game, and a chance game. Moreover, it is possible to realize the development game that can shift from the chance game to the main bonus game or the sub-bonus game, and that can shift from the sub-bonus game to the main bonus game.

Moreover, image data such as symbols or characters which are necessary for realizing a game, a pay table, and a table correlating to symbols and bonus contents chosen in a bonus game may be incorporated in the program 50 or the image data may be installed in a computer from the source other than the program. Moreover, any module which is necessary for the processing performed in the slot machine 1 may be incorporated into the program 50 other than the module shown in FIG. 17.

Moreover, the recording medium may be any medium as far as such information can be read by the computer. For example, a magnetic disk such as a floppy disk, a Laser Disk such as DVD, and a semiconductor storage device are applicable.

Suitable embodiment of the present invention has been explained as above, but the present invention is not limited to the embodiment as mentioned above. In the embodiment, the display region of three rows by five columns is set up in the display section, but, in addition, an array of a display region having various kinds of embodiments can be set up. Moreover, the Toby symbol is allowed to be displayed only in the reel image where the varying display is stopped first, and the Madonna symbol and the bulldog symbol are allowed to be displayed only in a reel image where the varying display is stopped at last, but it is possible to set up an embodiment wherein symbols are displayed in other reel images. Besides, it is also possible to set up to display the bulldog symbol and the Madonna symbol in different reel images.

Moreover, it is not necessarily determined that the main bonus game and the sub-bonus game are started even if the doghouse symbol is displayed in the above-described embodiment. In contrast to this, it is possible to make a state where the main bonus game is determined at a point of time when the doghouse symbol is displayed or a state where the sub-bonus game is determined to start or either the main bonus game or the sub-bonus game is determined to start.

On the other hand, in the aforementioned embodiment, the main bonus and sub bonus games are set up as a bonus game, but only one kind of bonus game can be set up, or more than three kinds of bonus games can be set up. Moreover, in the above-described embodiment, the chance game is set up as a different game, but such a state can be modified so that the different game is the bonus game.

As described above, according to the present invention, it is possible to provide a gaming apparatus with raised attractiveness, a control method of a gaming apparatus, a program, and a recording medium readable by a computer, by making a variety of display for announcing the game state.

What is claimed is:

1. A gaming apparatus comprising:

a display having a plurality of display regions where a plurality of types of symbols are variably displayed; and a controller executing a predetermined program and controlling display contents of said display, wherein said controller:

determines a symbol to be displayed in each of said display regions among said plurality of types of symbols when said symbols being variably displayed in said plurality of display regions are stopped in accordance with said predetermined program, wherein a last display region in which the symbols being variably displayed are stopped last is determined;

executes a basic game for judging a prize based on an arrangement of symbols to be stopped and appear in said plurality of display regions;

stops said plurality of types of symbols being variably displayed in said plurality of display regions sequentially;

displays a predetermined symbol in the last display region when a predetermined condition is fulfilled;

makes a predetermined pattern motion-displayed from said predetermined symbol toward a display region other than the last display region; and executes a first different game from said basic game after motion-displaying said predetermined pattern such that the plurality of types of symbols are variably displayed on the last display region again for a lottery for shifting to a second different game.

2. The gaming apparatus according to claim 1, wherein an operation of variably displaying on the last display region after motion-displaying the predetermined pattern is repeated when a shift condition is not satisfied.

3. The gaming apparatus according to claim 2, wherein said predetermined symbol appearing in the last display region is a second predetermined symbol when a second predetermined condition is fulfilled, and the second different game is executed when the second predetermined symbol appears in the last display region.

4. The gaming apparatus according to claim 1, wherein said controller determines a first display region in which the symbols being variably displayed are stopped first and the determined symbol appearing in the first display region is a predetermined first symbol; and wherein said predetermined condition includes the appearance of said predetermined first symbol.

5. The gaming apparatus according to claim 4, wherein said predetermined symbol appearing in the last display region is a second predetermined symbol when a second predetermined condition is fulfilled, and the second different game is executed when the second predetermined symbol appears in the last display region.

6. The gaming apparatus according to claim 1, wherein said predetermined symbol appearing in the last display region is a second predetermined symbol when a second predetermined condition is fulfilled, and the second different game is executed when the second predetermined symbol appears in the last display region.

7. A control method of a gaming apparatus including a display having a plurality of display regions where a plurality of types of symbols are variably displayed, and a controller executing a predetermined program and controlling display contents of said display, the control method comprising the steps of:

determining a symbol to be displayed in each of said display regions among said plurality of types of symbols when said symbols being variably displayed in said plurality of display regions are stopped in accordance with said predetermined program, wherein a last display region in which the symbols being variably displayed are stopped last is determined;

stopping said plurality of types of symbols being displayed variably in said plurality of display regions sequentially;

executing a basic game for judging a prize based on an arrangement of symbols to be stopped and displayed in said plurality of display regions;

displaying a predetermined symbol in the last display region when a predetermined condition is fulfilled;

making a predetermined pattern motion-displayed from said predetermined symbol toward a display region other than the last display region when the predetermined condition is fulfilled; and executing a first different game from the said basic game after motion-displaying said predetermined pattern such that the plurality of types of symbols are variably displayed on the last display region again for a lottery for shifting to a second different game.

8. The control method according to claim 7, and further comprising the step of:

determining a first display region in which the symbols being variably displayed are stopped first, and the determined symbol appearing in the first display region is a predetermined first symbol;

wherein said predetermined condition includes the appearance of said predetermined first symbol.

9. The control method according to claim 8, wherein said predetermined symbol appearing in the last display region comprises another kind of symbol such that the second different game is executed when said another kind of symbol appears in the last display region.

10. The control method according to claim 7, wherein said predetermined symbol appearing in the last display region comprises another kind of symbol such that the second different game is executed when said another kind of symbol appears in the last display region.

11. A computer readable program storage medium storing:

a program configured for displaying a plurality of display regions where a plurality of types of symbols are displayed variably, the plurality of display regions being provided on a display of a gaming apparatus;

a program configured for determining a symbol to be displayed on said plurality of symbol display regions and determining a last display region in which the symbols being variably displayed are stopped last;

a program configured for executing a basic game for judging a prize based on an arrangement of symbols to be stopped and appear in said plurality of display regions;

a program configured for stopping said plurality of types of symbols being variably displayed in said plurality of display regions sequentially;

a program configured for displaying a predetermined symbol in the last display region when a predetermined condition is fulfilled;

a program configured for making a predetermined pattern motion-displayed from said predetermined symbol toward a display region other than the last display region; and a program configured for executing a first different game from said basic game after motion-displaying said predetermined pattern such that the plurality of types of symbols are variably displayed on the last display region again for a lottery for shifting to a second different game.

12. The program storage medium according to claim 11, and further storing:

a program configured for determining a first display region in which the symbols being variably displayed are stopped first, and the determined symbol appearing in the first display region is a predetermined first symbol;

wherein said predetermined condition includes the appearance of said predetermined first symbol.

13. The program storage medium according to claim 12, wherein said predetermined symbol appearing in the last display region is a second predetermined symbol when a second predetermined condition is fulfilled, and the second different game is executed when the second predetermined symbol appears in the last display region.

14. The program storage medium according to claim 11, wherein said predetermined symbol appearing in the last display region is a second predetermined symbol when a second predetermined condition is fulfilled, and the second different game is executed when the second predetermined symbol appears in the last display region.

* * * * *